US005337552A

United States Patent [19]

Schuller et al.

[11] Patent Number: 5,337,552

[45] Date of Patent: Aug. 16, 1994

[54] OPEN-END SPINNING MACHINE FRAME STRUCTURE

[75] Inventors: Edmund Schuller; Rupert Karl, both of Ingolstadt; Anton Stanglmair, Elsendorf; Gottfried Schneider, Ingolstadt, all of Fed. Rep. of Germany

[73] Assignee: Rieter Ingolstadt Spinnereimaschinenbau AG, Ingolstadt, Fed. Rep. of Germany

[21] Appl. No.: 906,314

[22] Filed: Jun. 29, 1992

[30] Foreign Application Priority Data

Jun. 28, 1991 [DE] Fed. Rep. of Germany ..... 4121437

[51] Int. Cl.[5] ..... D01H 4/08

[52] U.S. Cl. ..... 57/406

[58] Field of Search ..... 57/404, 406, 407

[56] References Cited

U.S. PATENT DOCUMENTS 3,455,097 7/1969 Rajnoha .
3,511,045 5/1970 Bures et al. .
3,774,382 11/1973 Bartling ..... 57/406 X
3,807,157 4/1974 Stahlecker ..... 57/406
3,811,256 5/1974 Bystron et al. .
3,859,779 1/1975 Furstenberg .
3,861,132 1/1975 Stahlecker et al. .
3,874,154 4/1975 Stahlecker et al. .
3,884,027 5/1975 Schumann et al. .
3,927,516 12/1975 Stahlecker ..... 57/407
3,936,995 2/1976 Laflaquiere et al. .
3,977,168 8/1976 Schewe ..... 57/406 X
4,030,279 3/1977 Rambousek et al. ..... 57/407
4,059,947 11/1977 Stahlecker ..... 57/407
4,060,963 12/1977 Stahlecker et al. .
4,098,065 7/1978 Stahlecker et al. ..... 57/406
4,122,655 10/1978 Anderson et al. ..... 57/407
4,125,990 11/1978 Stahlecker et al. .
4,204,391 5/1980 Clayton et al. .
4,222,225 9/1980 Stahlecker et al. .
4,245,460 1/1981 Staufert et al. .
4,255,925 3/1981 Marzoli .
4,516,396 5/1985 Stahlecker et al. .
4,753,067 6/1988 Landwehrkamp et al. ..... 57/406 X
4,862,686 9/1989 Stadele et al. .

*Primary Examiner*—Joseph J. Hail, III
*Attorney, Agent, or Firm*—Dority & Manning

[57] ABSTRACT

In an open-end spinning machine is provided with a plurality of spinning stations installed next to each other. Each station having a spinning element part of a drive unit, and an opener unit contained in several assemblies. A plurality of longitudinal structure elements are provided to which the assemblies of the spinning device are attached. The longitudinal structural elements are interconnected by transversal bracing. The transversal bracing may be an intermediate wall.

33 Claims, 3 Drawing Sheets

OPEN-END SPINNING MACHINE FRAME STRUCTURE

BACKGROUND OF THE INVENTION

The instant invention relates to an open-end spinning machine with a plurality of spinning stations placed next to each other. Each station having a spinning device containing in several assemblies a spinning structural element, part of a drive unit for the spinning structural element, as well as an opener unit.

In a known device of this type (U.S. Pat. No. 4,516,396) two lateral walls are provided for each spinning station, said walls being connected to each other by the rotor bearing, the opener device with the delivery roller, and the rotor housing. These three assemblies are mounted independently of each other in the machine frame and although this facilitates replacement that may be required, it is at the cost of low machine rigidity and complexity in the structure of the individual spinning stations.

OBJECT AND SUMMARY OF THE INVENTION

It is a principal object of the instant invention to create an open-end spinning machine of the type mentioned above which offers optimal accessibility and replaceability of the above-mentioned assemblies, is of simpler construction and, thanks to great rigidity maintains precise dimensional stability over a long period of time, even during transport from manufacturer to spinning plant.

Additional objects and advantages of the invention will be set forth in part in the following description, and in part will be obvious from the description, or may be learned by practice of the invention.

This object is attained by the invention in that a plurality of longitudinal structural elements to which the spinning device is attached is provided in the area of the assemblies of said spinning device. The longitudinal structural elements lend the spinning machine great rigidity. Since the assemblies are attached directly to the longitudinal structural elements, the assemblies maintain their precise relative position over a long period of time and furthermore contribute further to increased machine rigidity due to the fact that the assemblies connect several longitudinal structural elements with each other.

In the interest of low-cost assembly it is advantageous for the longitudinal structural elements to extend over several adjoining spinning stations. In this case the spinning machine is provided advantageously with at least one machine section, with the longitudinal structural elements supporting the assemblies of the spinning device extending over the entire length of the section.

It is especially advantageous for each assembly of the spinning device to be supported on two longitudinal structural elements, one element being assigned to several assemblies jointly. In this way the essential assemblies which must be adjusted in relation to each other are located on one and the same longitudinal structural element on which they can easily be brought into their desired relative positions by axial adjustment. The adjustments are directly in relation to each other through relative alignment in relation to the lateral walls, thus simplifying assembly and adjustment. Furthermore, the relative positions are set securely in the plane which is perpendicular to the longitudinal axis of the machine by means of the longitudinal structural elements which are designed to be anti-rotation devices. The device according to invention is therefore easy to manufacture since the essential bearing and supporting structural elements are made in form of longitudinal structural elements, making it possible to achieve precise and also low-cost production.

The assembly mounted on the common longitudinal structural element is preferably provided with two bearings at a distance from each other by means of which the assembly is mounted on the common longitudinal structural support element. This makes it possible to achieve especially good and secure support of the assembly, thus considerably facilitating perfect adjustment. The most essential elements which must be adjusted in relation to each other are the assembly with at least part of the drive unit of the spinning element and the assembly with the opener unit, while the assembly with the spinning element can be adjusted with relatively wide tolerances in relation to the other two assemblies. For this reason provisions are made for the assembly with at least part of the drive unit of the spinning element to be fixedly mounted on the common longitudinal structural element axially in relation to same and to be provided with a limit stop against which the assembly with the opener unit lies. The assembly with at least part of the drive unit of the spinning element serves as a setting gauge for the assembly with the opener unit.

The location of the fixed point according to which the assemblies are adjusted axially, i.e. in the longitudinal direction of the machine, is in principle of secondary importance. Thus a limit stop against which the assemblies lie directly or indirectly can be provided between two spinning stations. In another advantageous embodiment of the device according to the invention an assembly with the opener unit or at least part of the drive unit of the spinning element can be made to bear directly against the limit stop located between two spinning stations, while the other one of these two assemblies bears against the first of these two assemblies. In this manner a very precise adjustment of the assemblies in relation to the spinning station and in relation to each other is achieved thanks to the axial fixing of the limit stop located between two spinning station and through the reciprocal support of the assemblies against each other.

Advantageously provisions are made for each of the assemblies to be provided with a limit stop serving as a bearing element for support on the common longitudinal structural element and for the longitudinal structural elements to bear upon each other in pairs.

The longitudinal structural elements supporting the assemblies are preferably connected to each other by means of transversal bracing. This transversal bracing counteracts sagging of the longitudinal structural elements.

It is not necessary to provide transversal bracing at every single spinning station. It has been shown that it suffices if such transversal bracing is provided only once between every two spinning station groups, each of which consists two spinning stations.

In another simple and especially advantageous embodiment of the invention, the transversal bracing is in the form of an intermediate wall.

In a preferred embodiment of the invention, if one limit stop is provided between two spinning stations it is constituted by the intermediate wall. In this case it is not even necessary to provide a separate limit stop between all adjoining spinning stations. According to the invention it is entirely sufficient for the limit stop to be provided only once between two spinning station groups, each of which consists of two spinning stations and to be assigned jointly to two adjoining spinning stations whose assemblies are mirror images of each other with respect to their limit stops which interact with the limit stop located between two spinning stations.

The assembly with the spinning element does not require as precise an adjustment as the other assemblies with the opener unit and the part of the drive unit of the spinning element because it is not the precise position of the assembly but, that of its appertaining spinning element which is important. For this reason it is sufficient in another embodiment of the invention if the assembly with the spinning element bears upon the assembly with the opener unit and the drive unit of the spinning element.

In order to simply achieve precise relative alignment of the assemblies for which alignment is especially important, the assembly with at least part of the drive unit of the spinning element is advantageously provided with a limit stop of defined width. Against one side of the limit stop is the assembly with the opener unit and at the other side is a cover of the spinning device, each bearing against the limit stop.

In a preferred embodiment of the device according to the invention, the assembly with the spinning element is provided with two symmetrical bearing elements surrounding two also symmetric bearing elements of one of the other assemblies or being surrounded by these.

It has been shown to be especially advantageous to position the second longitudinal structural element assigned to the assembly containing the spinning element essentially above the common longitudinal structural element, to position the second longitudinal structural element assigned to the assembly with the opener unit essentially below said common longitudinal structural element and to position the second longitudinal structural element assigned to the assembly with at least part of the drive unit of the spinning element essentially behind the common longitudinal structural element. Accessibility of the individual assemblies is best achieved with such an arrangement.

Secure and precise positioning and good replaceability can best be achieved according to the invention by connecting the assemblies to their longitudinal structural elements in a detachable manner.

Since the assembly with the spinning element must be especially easy to replace, as only its removal makes the assembly with the drive unit of the spinning element accessible, another preferred embodiment provides for the assembly with the spinning element to be connected to its appertaining longitudinal structural element by means of a clip connection.

The longitudinal structural element assigned to the assembly with the drive element of the spinning element is equipped with a brake for the spinning element extending into this assembly so that the assembly of the spinning element and its drive element may easily be provided with a brake for the spinning element.

When two drive belts capable of being put selectively into service are assigned to the spinning element it is advantageous for the second longitudinal structural element assigned to the assembly with at least part of the drive unit of the spinning element to be equipped with a switch-over device to switch the drive of the spinning element over from one to the other drive belt.

It is advantageous if at least one additional longitudinal structural element, preferably in the form of a pipe going through the intermediate wall, is provided for additional rigidity of the machine.

As mentioned earlier it is not necessary for the assembly with the spinning element to be positioned very precisely in relation to the other assemblies. In order to make it nevertheless possible to achieve precise alignment of the spinning element when it is in the form of a spinning rotor mounted on a shaft extending through a bottom of the assembly containing the spinning element. The bottom of the assembly can be provided with a section that is floatingly supported and through which the shaft extends. In this manner the spinning rotor is able to assume the position it is prescribed by the assembly with the drive element, even when the assembly with the spinning element is not adjusted very precisely in relation to the assembly with the drive element of the spinning element.

When the spinning element operates with negative pressure and the assembly containing the spinning element is provided with a housing capable of being connected to a suction circuit for that purpose, an advantageous embodiment of the invention provides for the interior of the housing which receives the spinning element in form of a spinning rotor to be essentially kidney-shaped, with the spinning rotor placed in its larger cross-sectional area and with its smaller cross-sectional area being capable of being connected to the stationary suction circuit installed in the machine. The "kidney shape" is to be interpreted in this case so that it may also comprise a helicoidal form if such a form has a center that is larger than the end section extending towards the outside.

In an embodiment of the invention with a spinning element in the form of a spinning rotor located in a housing having a suction air opening capable of being connected to a suction circuit installed in the machine, an elastic sealing element is advantageously provided at the passage between suction air opening and suction circuit. In this manner small tolerances can be compensated for without any problem.

In order to mount an assembly on the round longitudinal structural element so that it is easily removed, it is advantageous for the bearing element of the assembly to consist of a first semi-circular bearing shell which is an integral part of the assembly, and of a detachable second semi-circular bearing shell.

In order to compensate for machine oscillations, provisions are made in an advantageous embodiment of the device according to the invention to mount the assembly with the spinning element preferably with intercalation of an elastic element on the common longitudinal structural element.

The device according to the instant invention is easy to produce and ensures rigid design of the machine so that misalignment of parts that are essential for spinning is avoided.

Only parts of simple design are required so that low-cost manufacture is possible. In addition the individual assemblies in the preferred configurations of the object of the invention can be adjusted very easily directly in relation to each other and not via some other assemblies so that great precision in adjustment can be achieved. The invention is not limited to any special open-end spinning machine but can be applied with advantage to different such machines, e.g. machines with a spinning element in form of a spinning rotor, with an electrostatic spinning element or with a spinning element in form of a friction element or spinning element pair.

Examples of embodiments of the object of the invention are explained in greater detail below with the help of drawings in which.

DESCRIPTION OF THE PREFERRED EMBODIMENTS

Figure 3:
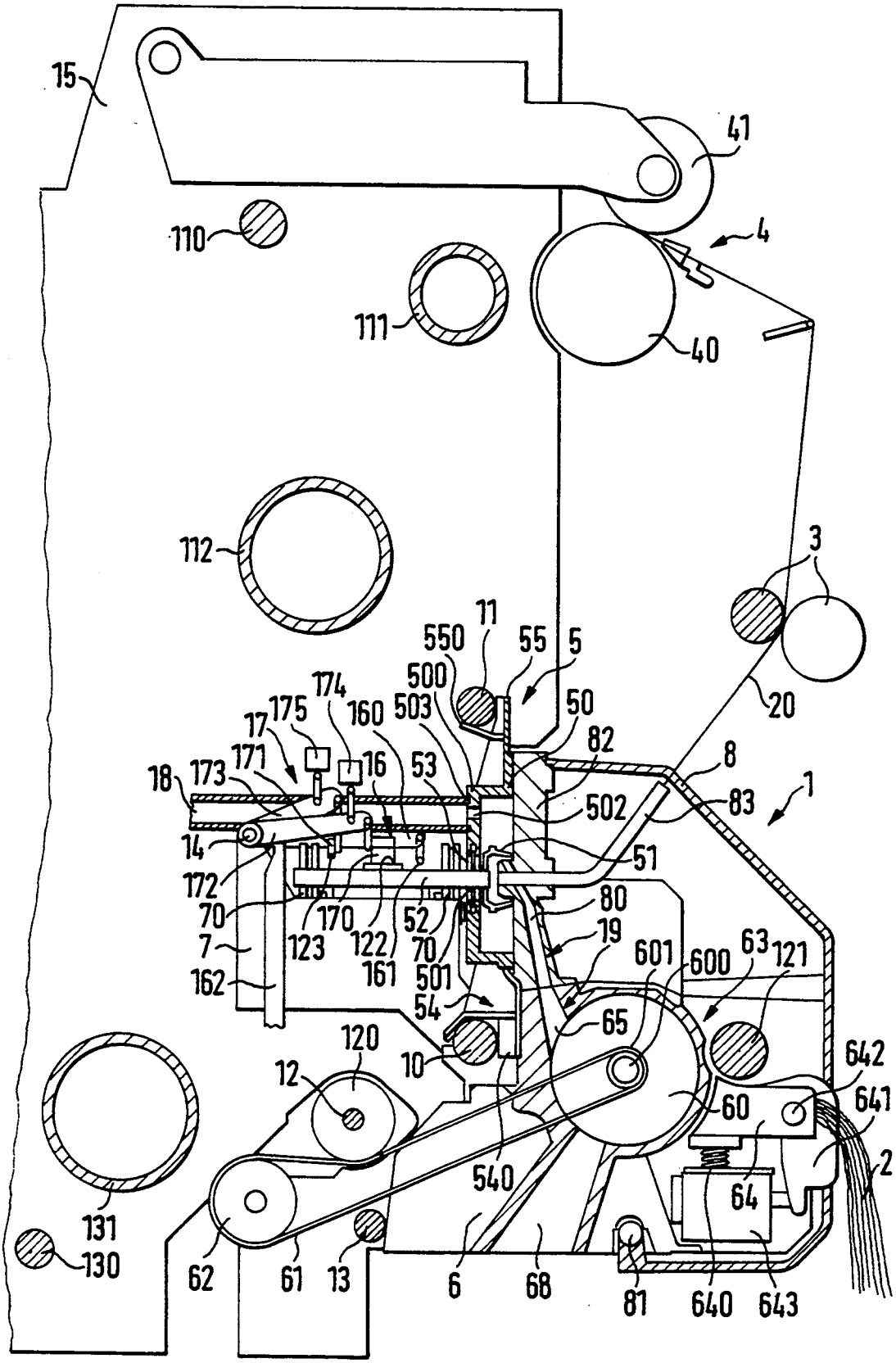
FIG. 3 shows a cross-sectional view through a spinning station in accordance with the instant invention.

An open-end spinning machine has a plurality of spinning stations next to each other, all of which are of identical design. One such spinning station is shown in FIG. 3. It is provided with a spinning device 1 to which a fiber sliver 2 is fed and in which this fiber sliver 2 is spun into a yarn 20. The yarn 20 is drawn off from the spinning device 1 by means of a pair of draw-off rollers 3 and is fed to a winding device 4 where it is wound on a driven bobbin 41 driven by a winding roller 40.

The spinning device 1 shown in FIG. 3 has essentially four assemblies 5, 6, 7 and 8.

The first assembly 5 has a housing 50 in which a spinning element 51 in form of a spinning rotor is located. It is mounted on a shaft 52 which extends through an opening 53 provided in the bottom 500 of the housing 50 into the third assembly 7. The opening 53 is substantially larger than the diameter of shaft 52 so that the spinning rotor is capable of assuming different relative positions in relation to the housing 50.

In the bottom 500 of the housing 50, in the area of the opening 53, a floor section 501 is floatingly supported. This floatingly supported floor section 501 receives shaft 52 and has therefore an inner diameter which is adapted precisely to the diameter of shaft 52. This floatingly supported floor section 501 must always ensure that the bottom 500 of housing 50 is sealed as much as possible in spite of different relative positions of the spinning element 51 in relation to housing 50.

Housing 50 is provided with a first bearing extension 54 by means of which the assembly 5 is supported, with intercalation of an elastic element 540, on a round longitudinal structural element 10. Thanks to this elastic element 540 oscillations of the machine can be compensated for to a great extent.

On the end away from the longitudinal structural element 10 the assembly 5 is provided with an additional bearing extension 55 by means of which said assembly 5 is secured on a round longitudinal structural element 11 which must prevent turning of the assembly 5 on the longitudinal structural element 10.

The second assembly 6 receives an opener unit which is constituted essentially by an opener roller 60 which is mounted with its axle 600 in the assembly 6. A wharve 601, surrounded by an endless belt 61, is installed on the free end of axle 600. Belt 61 also surrounds an additional wharve 62 which is movably mounted across from the assembly 6 in a manner not shown so that it is able on the one hand to keep the belt 61 under tension and is on the other hand also able to move a pre-stressing element, e.g. a compression spring (not shown) in opposition to the direction of the action so that the belt 61 can be removed if necessary. Since such designs are usual ones this mechanism was not shown in detail for the sake of simplification.

A trunk of belt 61 is applied against a drive disk 120 mounted on a drive shaft 12 which thus drives the opener roller 60 via belt 61.

A recess 63 in which a delivery roller 121 extends in the longitudinal direction of the open-end spinning machine is provided in assembly 6. A feeding tray 64 interacts with the delivery roller 121 and is, together with delivery roller 121, part of the feed unit by means of which the fiber sliver 2 can be fed to the opener roller 60. The feeding tray 64 is mounted on the assembly 6 by means of a bearing bolt 642 and is pressed by means of a compression spring 640 against said delivery roller 121. A clamping lever 641 is installed on the same bearing bolt 642 as the feeding tray 64. It functions in a known manner in interaction with the feeding tray 64 and is subjected to the control of a solenoid 643 which is also mounted on the assembly 6.

A portion 65 of a fiber feeding channel 19 which is continued through continuation 80 in assembly 8 and is to be discussed further below extends from the opener roller 60 in direction of assembly 5.

Assembly 6, just as assembly 5, is mounted on the longitudinal structural element 10 and is in addition supported by a round longitudinal structural element 13 which is located at the end of assembly 6 away from the longitudinal structural element 10 and is thus secured against rotating on the longitudinal structural element 10.

In addition to the two above-mentioned assemblies 5 and 6, the third assembly 7 which receives part of the drive unit of the spinning element 51 in the form of a spinning rotor is also mounted on the longitudinal structural element 10. As shown in FIG. 3, the drive unit consists of a drive belt 122 located outside assembly 7 and driven in the conventional manner. Drive belt 122 is brought to bear against shaft 52 of spinning element 51 or can again be lifted away from shaft 52 of spinning element 51 when it is to be stopped. Assembly 7 includes an element located in the assembly and equipped essentially with two pairs of support disks 70 mounted in a known manner.

Assembly 7 is supported on its end away from longitudinal structural element 10 by a longitudinal structural element 14 and is thus secured against rotating on the longitudinal structural element 10.

As shown in FIG. 3, a fourth assembly 8 is also provided and mounted by means of a bearing bolt 81 on the second assembly 6. This fourth assembly 8 serves as a top for the three assemblies 5, 6 and 7 and bears a rotor housing cover 82 by means of which the open side of housing 50 of the spinning element 51 can be covered. This rotor housing cover 82 receives the previously mentioned continuation 80 of the fiber feeding channel 19 which starts in assembly 6. Furthermore this assembly 8 contains a conventional yarn draw-off channel 83 which lets out centrally into the spinning element 51.

As shown in the above description, the first, second and third assemblies 5, 6 and 7 are mounted on a common round longitudinal structural element 10. To fix their respective rotational position, separate longitudinal structural elements 11, 13 and 14 are provided for each assembly 5, 6 and 7, so that each assembly 5, 6 and 7 is supported by two longitudinal structural elements 10 and 11, 10 and 13, or 10 and 14. The round longitudinal structural elements 11, 13 and 14 serve as anti-rotation devices for these three assemblies 5, 6 and 7. In the embodiment shown in FIG. 3 the fourth assembly 8 is not mounted on the longitudinal structural element 10, although this would be possible, as shall be explained further below in the embodiment shown in FIG. 1.

The longitudinal structural elements 10, 11, 13 and 14 are located in the area of assemblies 5, 6, 7, and possibly 8. They reinforce the machine or its section precisely in the area in which dimensional stability is especially important for functional reasons, and this is achieved by the rigidity imparted by the longitudinal structural elements.

The longitudinal structural elements 10, 11, 13 and 14 are round in the embodiment described, i.e. in form of axles around which the assemblies 5, 6 and 7 can be swivelled to facilitate installation or removal. Depending on relative attribution, this is however not an absolute requirement. Thus one or several or possibly all longitudinal structural elements may have non-round profiles, e.g. rectangular profiles, L-shaped profiles, round profiles with flattened mounting surface, etc.

Within the swivelling range of their assigned assemblies 5, 6, 7 and possibly 8, the longitudinal structural elements 11, 13 and 14 can be in principle located at any desired distance from the longitudinal structural element 10. However, the greater the distance between longitudinal structural element 10 and any of the longitudinal structural elements 11, 13 or 14, the easier it is to achieve a precise relative rotational position of assemblies 5, 6, 7 and possibly 8. For this reason the longitudinal structural elements 11, 13 or 14 in the shown embodiment are each located at the greatest possible distance from the common longitudinal structural element 10, i.e. at the end of an assembly 5, 6 or 7 away from the longitudinal structural element 10.

The round elements, i.e. the longitudinal structural element 10 and the longitudinal structural elements 11, 13 and 14 which serve to bear and support the three assemblies 5, 6 and 7, are produced simply by lathe and thus allow for low-cost manufacture. This is in contrast to the classical bearing elements which require very precise machining in their bearing and attachment areas.

The longitudinal structural elements 10, 11, 13 and 14 extend in longitudinal direction of the open-end spinning machine over at least one spinning station, but preferably over a plurality of adjoining spinning stations. Normally open-end spinning machines consist of a plurality of sections, each of which comprises a plurality of spinning stations installed next to each other. In that case, the longitudinal structural elements 10, 11, 13 and 14 extend as a rule over the entire section length.

The round assemblies, i.e. the longitudinal structural elements 10, 11, 13 and 14 are normally relatively rigid. In order to increase this rigidity and to permanently ensure the precise relative positions of the longitudinal structural elements 10, 11, 13 and 14, and thereby also of the assemblies 5, 6, 7 and possibly 8, the longitudinal structural elements 10, 11, 13 and 14 serving as anti-rotation devices for assemblies 5, 6 and 7 are connected to each other by transversal bracing. Individual braces used as transversal bracing can be provided between any pair of elements, i.e. between the longitudinal structural element 10 and one of the longitudinal structural elements 11, 13 or 14 serving as anti-rotation devices. In a preferred embodiment shown in FIG. 3, a common element instead of a plurality of individual braces is provided, said common element being in form of an intermediate wall 15 between adjoining spinning stations.

Not only is the relative rotational position of the individual assemblies 5, 6, 7 and 8 in relation to each other important for good spinning results, but also the lateral relative positioning of the assemblies 5, 6, 7 and 8. For this reason it is necessary for the assemblies 5, 6 and 7 which are located on the longitudinal structural element 10 to be positioned precisely in its longitudinal direction. According to FIG. 1 the third assembly 7 is therefore fixed axially on the round longitudinal structural element 10. This third assembly 7 has two bearings 71 and 72 at a distance from each other, of which bearing 71 is made in form of a limit stop. On the one side of this bearing 71, second assembly 6 bears with a bearing 66 which is also in form of a limit stop by means of which assembly 6 is mounted on the longitudinal structural element 10.

Figure 1:
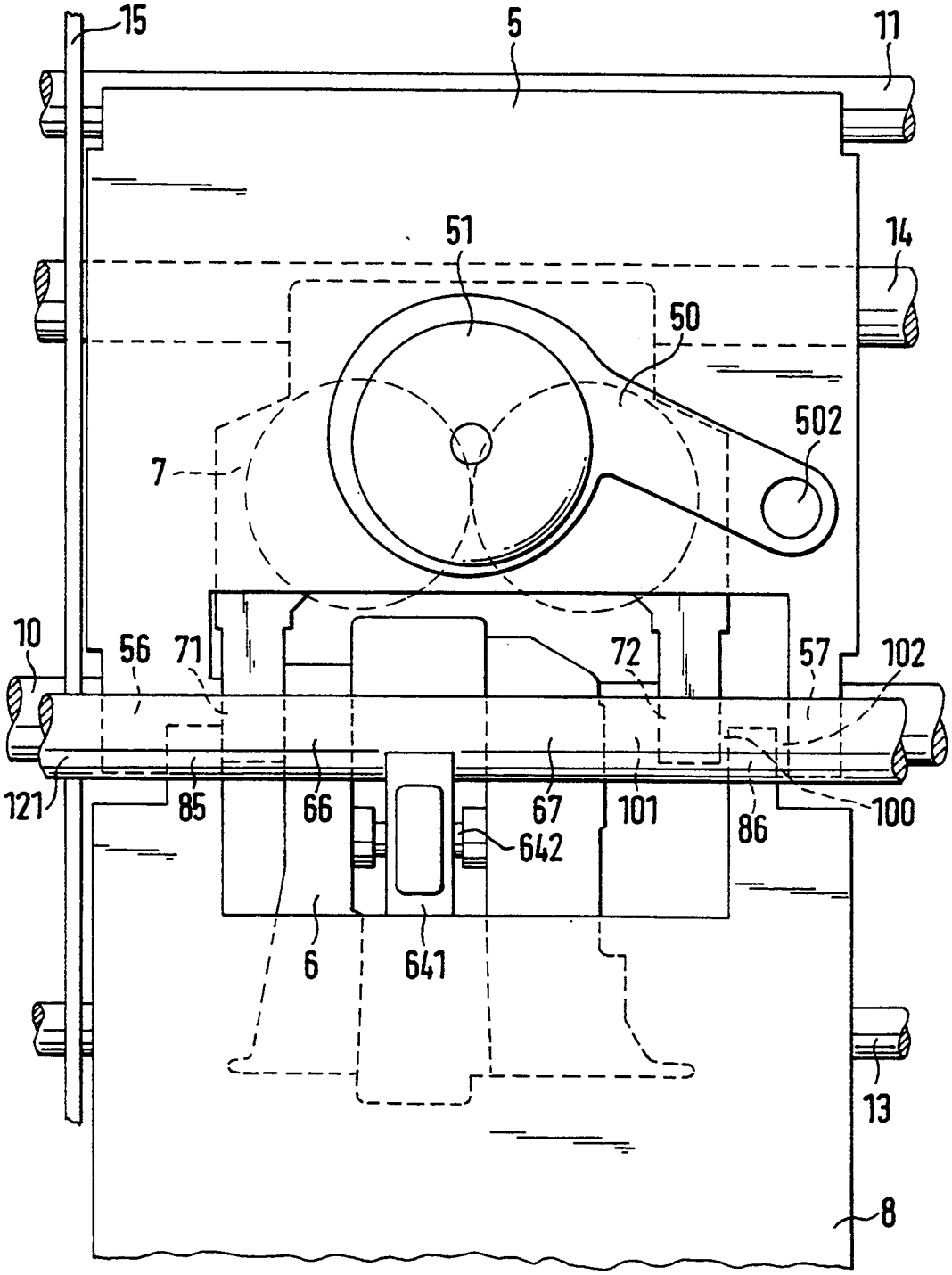
FIG. 1 shows an open-end spinning station designed in accordance with the invention, in schematic front view.

Assembly 6 is also provided with a second bearing 67, whereby the two bearings 66 and 67 are surrounded by the two bearings 71 and 72 of assembly 7. As shown in FIG. 1, assembly 6 bears with its bearing 66 in form of a limit stop against the bearing 71 in form of a limit stop of assembly 7, while a clearance 101 remains between bearing 67 of assembly 6 and bearing 72 of assembly 7.

Bearing 71 of assembly 7 has a defined width since it serves not only as a limit stop for assembly 6 but, with its other side, also as a limit stop for the fourth assembly 8, whereby assembly 7, with its bearings 71 and 72, is surrounded by two bearings 85 and 86 of assembly 8 which it is mounted on the longitudinal structural element 10. In this case assembly 8 bears with its bearing 85 in the form of a limit stop against bearing 71 while a clearance 100 remains between the bearings 86 and 72.

Assemblies 6 and 8 are thereby fixed on the longitudinal structural element 10 in its axial direction, with their positions being set parallel to the longitudinal structural element 10 by the bearings 71, 85 and 66 in the form of limit stops.

The first assembly 5 is also mounted by means of two bearings 56 and 57 positioned at a distance from each other on longitudinal structural element 10 which thus serves as bearer for all four assemblies 5, 6, 7 and 8. Bearing 56 is also in the form of a limit stop and interacts with bearing 85 serving as a bilateral limit stop of the fourth assembly 8, while clearance 102 is provided between bearings 86 and 57.

The first assembly 5 is therefore aligned merely indirectly from the third assembly 7 over the fourth assembly 8. Tolerance increases that may result from this are however compensated for by the floating bottom section 501 of housing 50, since this bottom section 501 allows for positioning of the spinning element 51 in the manner prescribed by third assembly 7.

Each of the four assemblies 5, 6, 7 and 8 is thus provided with a limit stop in form of a bearing 56, 85, 71 or 66 respectively which are in mutual contact by pairs. According to FIG. 1 these are respectively bearings 56, 85, 71 and 61 on one side of the spinning device 1. It is also possible to distribute the pairs of limit stops over both sides of the spinning device 1, for instance by having bearings 71 and 66 interact on one side and bearings 72 and 86 on the other side, etc. The clearance 100 or 101 is therefore provided once on one side and once on the other side of the spinning device 1. A similar principle applies to the adjustment of the first assembly 5 by means of its bearing 56 or 57 and for the provision of clearance 102 on one or the other side of the spinning device 1.

The described embodiment of the open-end spinning machine makes it possible to achieve easily a very precise alignment of the different assemblies 5, 6, 7 and possibly 8 in relation to each other. Since the assemblies are mounted independently of each other on the longitudinal structural elements 10, 11, 13 and 14, the arrangement can also be made in such manner that an assembly of this spinning station can be installed and removed independently of the other assemblies. If necessary, another assembly must be swivelled on the longitudinal structural element 10 or must be removed from same in order to render the assembly to be removed accessible, as shall be described further below.

In assembly 8 shown in FIG. 1 serving as a cover, an additional longitudinal structural element serving as an anti-rotation device can be dispensed with if assembly 8 is mounted on the longitudinal structural element 10 since assembly 8 bears upon housing 50 of assembly 5 and/or upon assembly 6 in its position covering spinning element 51 and upon assembly 6 in its release position.

As described earlier, assembly 5, which contains a spinning rotor, is provided with a floatingly mounted bottom section 501. This floatingly mounted bottom section 501 makes it possible for the spinning element 51 to align itself in relation to the housing 50 so as to adapt its position exactly to the third assembly 7 and to its pair of support disks 70. It is however important for the continuation 80 of the fiber feeding channel 19 letting out into the open side of a spinning element 51 for example to be aligned exactly in relation to the spinning element 51. Since the position of the spinning element 51 depends on the position of the assembly 7, assembly 8 must also be aligned precisely in relation to assembly 7. This is accomplished in that assembly 8 bears with its bearing 85 made in form of a limit stop against the bearing 71 of assembly 7 which also serves as a limit stop. The section element 65 of the fiber feeding channel 19 must be aligned precisely with the continuation 80 of the fiber feeding channel 19 installed in assembly 8. For this reason the position of assembly 6 is determined also by the limit stop bearing 71 of assembly 7, whereby bearing 71 has a defined width for that purpose.

If the floating bottom section 501 were to be omitted, as is possible in principle, this would require a very precise adjustment of assembly 5 and a relatively large remaining opening 53 in the bottom 500 of housing 50. This is because the opening 53 may not be too small because of unavoidable residual imbalance of the spinning element 51. If a pair of friction spinning elements instead of a spinning rotor are used as the spinning element, a floating bottom section 501 in the appropriately designed housing 50 and, under certain conditions, even the housing of assembly 5 can be omitted.

Instead of the third assembly 7 being fixed axially on the longitudinal structural element 10 with the first assembly 5 bearing upon the third assembly 7, the second assembly 6 can also be fixed axially on longitudinal structural element 10 and the first assembly 5 can then bear against it.

It goes without saying that assemblies 5 and 6 bearing on a limit stop (e.g. on the third assembly 7) must also be secured axially on the longitudinal structural element 10 once their axial adjustment has been effected.

Assemblies 5, 6 and 7 (and with a design of the spinning station according to FIG. 1 also assembly 8) may be connected to the longitudinal structural elements 10, 11, 13 and 14 in any desired manner. This can be done for example by designing each of the bearings 56, 57, 66, 67, 71, 72, 85, 86 so as to consist of two semi-circular bearing shells (see bearing shells 710, 711 and 720, 721 of FIG. 2) of which one half-shell (see bearing shells 710, 720) are an integral part of the respective assemblies while the other half-shell (see bearing shells 711, 721) can be connected thereto by means of a screw connection or similar connection.

As shown in FIG. 3, assembly 5 is suitably installed on the longitudinal structural elements 10 and 11 by means of a clip connection so that assembly 5 can be removed from the longitudinal structural elements 10 and 11 by unclipping.

Alternatively, it is also possible to attach a mounting on the longitudinal structural element 10 and the corresponding longitudinal structural element 11, 13, 14, etc. to which the respective assembly 5, 6, and 7 is screwed. Alternatively, the longitudinal structural elements (or at least one of them) can be given a non-round profile.

With the described design of a spinning device 1 the assemblies 5, 6 and 7 are not only secured in the desired manner in the chosen relative positions in relation to each other, but the individual assemblies 5, 6, 7 are easily removable.

The first assembly 5 can be removed without prior removal of any other assembly. It suffices to render assembly 5 accessible by swivelling assembly 8, which serves as a top or cover, downward. The first assembly 5 is attached to longitudinal structural element 10 and to longitudinal structural element 11 merely by being clipped on can be removed from its mounting.

To remove the third assembly, assembly 8 is first swivelled downward, around longitudinal structural element 10. Assembly 5 can then be detached easily from the longitudinal structural element 11 and be removed from longitudinal structural element 10. Now assembly 7 is also freely accessible and can be removed from longitudinal structural element 14 and from longitudinal structural element 10. The appropriate attachment must of course be opened for this.

If it should become necessary to remove assembly 6 or possibly 8, such is possible without prior removal of one of the two assemblies 5 and 7.

Figure 2:
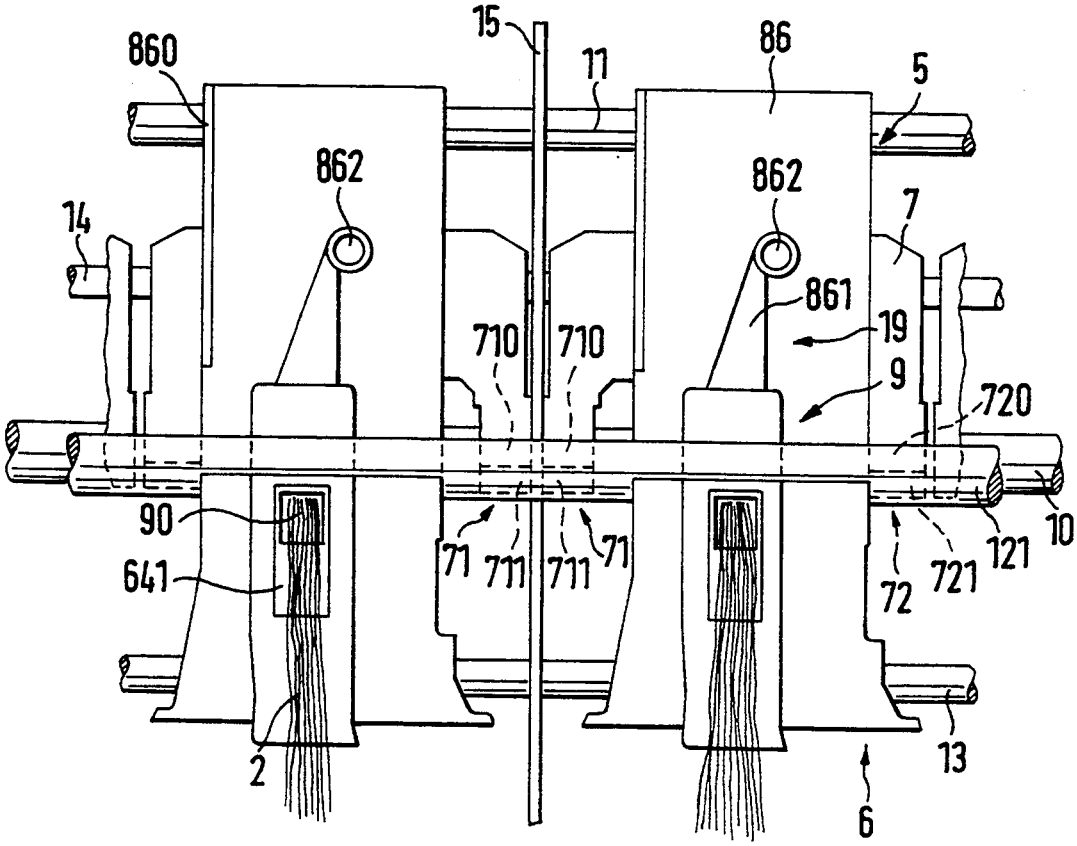
FIG. 2 shows a variant of the device shown in FIG. 1.

As shown in FIGS. 1 and 2, it is not necessary to provide the transversal bracing in form of an intermediate wall 15 between every two adjoining spinning stations so that each spinning station is located between two such intermediate walls 15. It is sufficient for one intermediate wall 15 to be provided only between two spinning station groups, each of which consists of two spinning stations, so that each spinning station is delimited on one side by an intermediate wall 15 and on its other side by the adjoining spinning station.

Although it is not necessary for each assembly to be provided with two bearings 56, 57, 66, 67 or 71, 72 placed symmetrically at a distance from each other, this is a preferred arrangement because in this manner secure support can be attained even by using small bearings, without any danger of adjustment changes occurring due to undesirable moments. To ensure that all the assemblies 5, 6 and 7 (and possibly 8) can be mounted on the round longitudinal structural element 10, several of the assemblies (e.g. 5, 8 and 7) surround other assemblies (e.g. 8, 7 and 6) so that the latter assemblies (e.g. 8, 7 and 6) are surrounded by the former assemblies (e.g. 5, 8 and 7).

According to FIG. 2, the assemblies 5 and 6 shown in FIGS. 1 and 3 are combined into a joint assembly 9, whereby the assembly 8 can be reduced to the size of a cover 86 which only covers assembly 5 which constitutes part of assembly 9. This assembly 86 therefore does not cover the feeding tray 64 and the clamping lever 641 of which the input opening 90 through which the fiber sliver 2 (see FIG. 1) is fed to the delivery roller 121, as can be seen in FIG. 2.

The hinged cover 86 installed at the top of joint assembly 9 is mounted by means of a hinge 860. This cover 86, similarly to assembly 8 (FIG. 3), receives the continuation 861 of the fiber feeding channel 19 which begins in assembly group 9. In addition, the fiber draw-off channel 862 is provided in cover 86.

According to FIG. 2 a limit stop in the form of an intermediate wall 15 is provided between two adjoining spinning stations. The limit stop can also be made in form of a stop ring or similar device installed on the longitudinal structural element 10. The assemblies 5 and 6 combined into assembly 9 and assembly 7 bear upon this stop directly or indirectly. For this purpose assembly 7 is again equipped with two bearings 71 and 72 placed at a distance from each other, of which the bearing 71 or 72 towards the intermediate wall 15 interacts with said intermediate wall 15 as a counter-bearing. The assemblies 7 of two adjoining spinning stations thus bear upon the common intermediate wall 15 and are fixed axially by same. Assembly 9 (combined assemblies 5 and 6) bears in turn with a limit stop (not shown) upon the bearing 71 serving as a limit stop of assembly 7. In this case assembly 7 serves as a setting gauge of assembly 9 while the axial position of assembly 7 is determined by an intermediate wall 15 serving as a bilateral limit stop, so that the position of assembly 9 is indirectly also determined by the intermediate wall 15. It is therefore required for the bearing 71 of assembly 7 which is towards the intermediate wall 15 to be made in the form of a bilateral limit stop which (as described) bears with its outside against the intermediate wall 15 while assembly 9 bears against its inside.

Once the individual assemblies have been placed in their correct relative positions they are fixed on the longitudinal structural element 10, this being effected most efficiently by directly attaching assembly 7 and assembly group 9 on the longitudinal structural element 10.

The third assembly 7 bears against intermediate wall 15 by means of the above-described embodiments. It is however also possible for the second assembly (which is constituted in this case by the assembly group 9) to bear against the intermediate wall 15 while the third assembly 7 bears against assembly 9.

Assembly group 9 in turn is again mounted on the longitudinal structural element 10 and is secured by a round longitudinal structural element 11 against rotation on longitudinal structural element 10. According to FIG. 2, longitudinal structural element 11 is placed above longitudinal structural element 10. It is also possible to provide a longitudinal structural element below longitudinal structural element 10 (see longitudinal structural element 13 in FIG. 3) or to provide one such longitudinal structural element above and one below longitudinal structural element 10 (FIG. 2).

With a design of spinning device 1 as shown in FIG. 2, the axial fixing of assembly 7 and of the assembly group 9 can of course be effected directly on the longitudinal structural element 10 as is shown in FIG. 1. Conversely, the assemblies 5, 6 and 7 (and possibly 8 if this assembly is not mounted on assembly 6) shown in FIG. 1 can be fixed axially by a limit stop located between two spinning stations, whereby said limit stop could be made in the form of an intermediate wall 15. If this limit stop, e.g. the intermediate wall 15, serves as a "setting gauge" it is merely necessary for one of the assemblies 7 or 6 or 9 of the assembly group consisting of the second assembly 6 (possibly integrated into assembly 9) and the third assembly 7 to bear directly against the limit stop, e.g. the intermediate wall 15, located between two spinning stations while the other assembly of this assembly group bears against the former assembly. In this case, the bearings of the assembly no longer interact with the limit stop located between two spinning stations and bear against each other in pairs.

If separate assemblies 5, 6 and 7 are provided, in an embodiment in which the intermediate wall 15 or some other stationary limit stop located between the spinning stations has been provided, each of the three assemblies 5, 6 and 7 is provided at its end towards said limit stop with a bearing element (bearing 56, 66 or 71) for mounting on the longitudinal structural element 10 for adjustment of the three assemblies 5, 6 and 7, whereby the bearing elements 71, 66 or 66, 56 (see FIG. 1) are bearing against each other in pairs. In a variant, it is also possible to bring only assembly 7 to bear against this limit stop with its bearing towards the limit stop located between two spinning stations, while assembly 9 (or assemblies 6 and 5) bear directly or indirectly against the other bearing 72 (see FIG. 1) of the assembly.

The described invention can be modified in different ways within the framework of the invention, e.g. by replacing individual characteristics by equivalents or through other combinations thereof. Thus FIG. 2 shows that it is not necessary for a limit stop to be provided as a setting gauge between every two spinning stations for the adjustment of the assemblies 5, 6 and 7 or 7 and 9, but that it suffices for such a limit stop, e.g. an intermediate wall 15, to be provided only once between two spinning station groups consisting each of two spinning stations and to be thus assigned jointly to two adjoining spinning stations. The assemblies are then mirror images of each other with respect to their limit stops assigned to this limit stop.

The feed unit can also be different from the embodiment described. For example, it is possible to provide an individual delivery roller (not shown) per spinning station which is placed and mounted similar to the feeding tray 64 in assembly 6 and which can be controlled by means of a controllable coupling.

In the embodiment shown in FIG. 3 the longitudinal structural element 11 serving as an anti-rotation device of the first assembly 5 is located above the longitudinal structural element 10. Assembly 5 thus extends essentially in a vertical direction. Depending on the design of the spinning element the position of assembly 5 can be different from that shown in the arrangement of FIG. 3, e.g. when it must be placed at an angle in case of a spinning element in form of a pair of friction elements. Nevertheless the longitudinal structural element 11 is located essentially above the round longitudinal structural element 10, even in this type of design.

Since the flow of material goes normally from bottom to top, in particular with the two-sided spinning machines commonly used today, it is advisable for the longitudinal structural element 13 which secures the second assembly 6 (which serves as feed unit of assembly 5) against rotation to be disposed below the longitudinal structural element 10.

With a horizontal arrangement of the spinning element 51, the drive device, of which a portion is located in assembly 7, is installed behind assembly 5, as seen from the operator's side. For this reason, as shown in FIG. 3, the longitudinal structural element 14 which is provided as an anti-rotation device for the third assembly is located essentially behind the longitudinal structural element 10.

The described positioning of the longitudinal structural elements 11, 13 and 14 in relation to longitudinal structural element 10 is not an absolute requirement but, is preferred in that the elements are placed at the greatest possible distance from longitudinal structural element 10, making it much easier to achieve a precise rotational positioning of assemblies 5, 6, 7 and possibly 8, and also creates in a simple manner the necessary conditions for good and rapid accessibility to the individual assemblies and rapid and easy installation and removal of these assemblies 5, 6, 7 and 8.

In the described embodiments the assemblies 5, 6 and 7 are fixedly removably connected to the longitudinal structural elements 10, 11, 13 and 14. This prevents relative movement between the longitudinal structural elements 10, 11, 13 and 14 in relation to each other as a result of vibration and jarring. It may suffice to set the assembly 5, 6 or 7 on the longitudinal structural element 10 (e.g. by means of a half shell) and against the longitudinal structural element 11, 13 or 14 (e.g. by means of elastic pressure effected by a spring), or merely by screwing the assembly to the longitudinal structural element 10 or attaching it in a similar fashion. It is also possible for assembly 5 to be attached by means of a catch or screw connection to the longitudinal structural element 10 and/or to the longitudinal structural element 11. If necessary, one of the other assemblies 6, 7 or 8 can also be secured by means of a quick-opening connection (catch or clip connection).

In principle a brake for spinning element 51, if one is needed, can be placed and mounted in any desired manner, e.g. on an intermediate wall 15. In the embodiment shown in FIG. 3 a brake 16 for the spinning element 51 extending into the third assembly 7 is provided on the longitudinal structural element 14, on which the third assembly 7 is mounted (in addition to the longitudinal structural element 10). The brake 16 can for example be provided with a swivel arm 160 mounted on the longitudinal structural element 14, with the actual brake 161 on the free end of swivel arm 160 which being brought into action on shaft 52 of the spinning element 51. The swivel arm 160 is connected in a conventional manner via a coupling link 162 to an actuating device (not shown).

When assembly 7 is to be removed, and depending on the design of brake 16, it is not necessary to remove same also from the longitudinal structural element 14, but it suffices to remove brake 16 from the range of assembly 7 by disabling pressure springs so that said assembly 7 can be moved between longitudinal structural element 10 and the longitudinal structural elements 11, 13, and 14, as required for its removal.

In the embodiment of spinning device 1 shown in FIG. 3, the spinning element 51 can be driven at two different speeds. For this purpose, in addition to the previously mentioned drive belt 122, a second narrower drive belt 123 is provided, whereby either one of the two drive belts 122 or 123 or the brake 161 can be brought to bear upon shaft 52 of the spinning element 51. The two drive belts 122 and 123 are held under tension in the conventional manner by tensioning rollers (not shown) and are normally located at a distance from shaft 52 of spinning element 51. To press the drive belt 122 or 123 against shaft 52, pressure rollers 170, 171 mounted on swivel arms 172 or 173 which are in turn connected to control magnets 174 or 175 or to some other appropriate drive are provided. The two swivel arms 172, 173 together with their pressure rollers 170, 171 constitute a switch-over device 17 by means of which the drive of the spinning element 51 can be switched from one to the other drive belt (122, 123) and back. The switch-over device 17, just as the previously described brake 16, can be mounted in any desired manner, e.g. on the intermediate wall 15. In the embodiment shown in FIG. 3, the longitudinal structural element 14 serves this purpose. To remove assembly 7, it suffices to disable springs (not shown) that bear upon the switch-over device 17.

In order to increase the precision of positions of the individual assemblies 5, 6, and 7 in relation to each other, the design of spinning device 1 shown in FIG. 3 provides not only for the already mentioned longitudinal structural elements 10, 11, 13 and 14 to extend through the intermediate wall 15, but the intermediate walls 15 are, in addition, traversed by at least one additional longitudinal structural element of the machine. According to FIG. 3 for example, two longitudinal structural elements 110 and 130 in form of rods are provided. Furthermore additional longitudinal structural elements 111, 112 and 131 in the form of pipes are provided. These additional longitudinal structural elements 110, 111, 112, 130, 131 extend over several adjoining spinning stations and are connected rigidly to the intermediate walls 15 by suitable means. Preferably the connection of the longitudinal structural elements, e.g. 10, 11, 13, 14, 110, 111, 112, 130, 131 to the intermediate walls 15 is effected through welding so that the strength of the connection between the longitudinal structural elements and the intermediate walls 15 is ensured.

Although it is possible, in principle, to mount one or the other longitudinal structural element 10, 11, 13 or 14 rotatably in the open-end spinning machine, for example in order to rotate the assembly 5, 6, 7 or 8 together with their longitudinal structural element 11, 13 or 14 serving as an anti-rotation device after detaching it from the longitudinal structural element 10 and thereby to bring it into the desired position for removal from the spinning station, it is preferred not to mount the longitudinal structural elements 11, 13 and 14 rotatably in the machine and to adjust the assemblies 5, 6, 7 or 8 in relation to their longitudinal structural element 11, 13 or 14 through rotation.

It is also possible to give one or the other of the longitudinal structural elements 10, 11, 13, 14 a length that is only equal to the width of a spinning station and to make it removable. This may be justified for special designs of a spinning station. As a rule however, it is better to install the longitudinal structural elements 10, 11, 13 and 14 in a non-removable manner in the machine, e.g. by welding them or at least screwing them to the intermediate walls 15 and to the end walls of a machine section.

According to FIG. 1 the interior of housing 50 of assembly 5 is substantially kidney-shaped, or substantially helicoidal, a form that should fall within the concept of kidney-shape, as explained earlier, in the larger cross-section of which the spinning element made in form of a spinning rotor is installed. The smaller cross section can be connected to a suction circuit 18 installed in the machine in a stationary manner. On the other hand, the suction circuit 18 can be installed in a stationary manner at the spinning station without affecting the replaceability of assembly 7. The suction circuit 18 can also be positioned next to assembly 7.

FIG. 3 shows a suction air opening 502 surrounded by an elastic sealing element 503 in the bottom 500 of housing 50. In placing assembly 5 in its operating position shown in FIG. 3, the suction circuit 18 comes to lie against this elastic sealing element 503 and thereby compensates possible minor tolerances between suction circuit 18 and the arrangement of assembly 5 without requiring therefore a telescopic design of the suction circuit 18 as would otherwise be required if the sealing element 503 is omitted.

As mentioned earlier, the mounting of the essential assemblies on a common longitudinal structural element 10 and the support of each of these assemblies (insofar as they are not mounted on some other assembly, such as for example assembly 8 which can be mounted on assembly 6) by another longitudinal structural element is not only possible when the spinning element 51 is a spinning rotor but also when it is, for example, an electrostatic element or a friction spinning element or a pair of friction spinning elements. In these cases the assemblies must of course be adapted to the design of the spinning element. But assembly 6 can also be given a different design, e.g. with one or several feed units, with a pressure roller instead of a feeding tray with a coupling for the delivery roller 121 instead of a clamping lever 641, with or without dirt collection opening 68, with an individual drive for delivery roller 121, etc. Beyond this, the third assembly 7 can also constitute a closed assembly if an individual drive is desired for the spinning element.

It will be apparent to those skilled in the art that various modifications and variations can be made in the apparatus and method of the present invention without departing from the scope or spirit of the invention. Thus, it is intended that the present invention cover the modifications and variations of this invention provided they come with the scope of the appended claims and their equivalents.

We claim:

1. An open end spinning machine having a plurality of spinning stations disposed adjacent each other along at least one side of the spinning machine; said spinning machine comprising:

a plurality of longitudinal structural elements running lengthwise along each side of said spinning machine, said longitudinal structural elements being separate and discrete when viewed at a cross section taken at the center of each spinning station;

a plurality of discrete assemblies for each said spinning station, whereby at least one said assembly comprises a spinning element, at least another said assembly comprises at least part of a drive unit for said spinning element, and at least a third said assembly comprises an opener unit; and whereby each said assembly of each said spinning station directly contacts and is removably attached to one common said longitudinal structural element and at least one other said longitudinal structural elements.

2. The spinning machine as in claim 1, comprising at least one machine section, said machine section comprising at least two said spinning stations, said longitudinal structural elements being continuous over the entire length of said machine section.

3. The spinning machine as in claim 2, wherein said section is defined between oppositely facing end walls, said longitudinal structural elements being rigidly affixed to said end walls.

4. The spinning machine as in claim 1, wherein said longitudinal structural elements are non-rotatably mounted in said spinning machine.

5. The spinning machine as in claim 1, wherein at least one of said longitudinal structural elements is in the form of a substantially round axle.

6. The spinning machine as in claim 1, wherein said assemblies are fixed in position along a common said longitudinal structural element by means of at least two bearings positioned at a distance from each other.

7. The spinning machine as in claim 6, wherein said assembly containing at least part of the drive unit of said spinning element is fixed axially along said common longitudinal structural element and comprises a limit stop against which said assembly with said opener unit bears.

8. The spinning machine as in claim 1, further comprising a limit stop disposed between two said spinning stations, whereby at least one said assembly of each of said two spinning stations directly bears against said limit stop.

9. The spinning machine as in claim 8, wherein said spinning stations on each side of said limit stop are mirror images of each other.

10. The spinning machine as in claim 1, further comprising a plurality of transversal bracing members interconnecting said longitudinal structural elements, said bracing members disposed between pairs of said spinning stations so that at least one side of each spinning station is adjacent a said bracing member.

11. The spinning machine as in claim 1, wherein one of said longitudinal structural elements is common to each of said plurality of discrete assemblies.

12. The spinning machine as in claim 11, wherein one of said longitudinal structural elements associated with said spinning element assembly is positioned essentially above said common longitudinal structural element, one of said longitudinal structural elements associated with said opener unit assembly is positioned below said common longitudinal structural element, and one of said longitudinal structural elements associated with said spinning element drive unit is positioned essentially behind said common longitudinal structural element.

13. The spinning machine as in claim 12, wherein said spinning unit assembly is removably attached to said common longitudinal structural element and its respective second longitudinal structural element by means of clip connections.

14. The spinning machine as in claim 11, wherein said assemblies are removably attached to said common longitudinal structural element by means of bearing elements, said bearing elements comprising a first semi-circular bearing shell integral with its respective said assembly, and a second semi-circular bearing element mateable with said first semi-circular element so that said common longitudinal structural element fits therethrough.

15. The spinning machine as in claim 11, wherein said spinning element assembly is supported on said common longitudinal structural element with intercalation of an elastic element.

16. The spinning machine as in claim 1, further comprising a brake for said spinning element, said brake supported on one of said longitudinal structural elements associated with said spinning element drive unit assembly.

17. The spinning machine as in claim 1, further comprising two drive belts for driving said spinning element, and a switch-over device for switching the drive of said spinning element from one of said belts to the other of said belts, said switch-over device supported on one of said longitudinal structural elements associated with said spinning element drive unit.

18. The spinning machine as in claim 1, wherein said spinning element assembly comprises a housing having a bottom and wherein said spinning element comprises a spinning rotor mounted on a shaft extending through said bottom of said housing, said bottom of said housing including a floatingly supported section through which said shaft extends.

19. The spinning machine as in claim 18, further comprising a rotor housing having an essentially kidney-shaped interior recess, said spinning rotor residing within a larger cross-sectional area of said recess, a smaller cross sectional area of said recess including a suction connection capable of being connected to a stationary suction circuit of said spinning machine.

20. The spinning machine as in claim 19, further comprising an elastic sealing element at the transition point from said suction connection and the stationary suction circuit.

21. The spinning machine as in claim 1, wherein at least one of said longitudinal structural elements is common to at least two said spinning stations along the respective side of the spinning machine.

22. The spinning machine as in claim 1, wherein said assembly with said spinning element comprises a housing including a suction connection capable of being connected to a stationary suction circuit of said spinning machine, and further comprising an elastic sealing element at the transition point from said suction connection and said stationary suction circuit.

23. The spinning machine as in claim 1, wherein at least one of said longitudinal structural elements is common to all of said assemblies along the respective side of the spinning machine.

24. The spinning machine as in claim 1, wherein said assembly comprising said spinning element and at least one other of said assemblies each comprise a pair of bearing elements mounted to one of said longitudinal structural elements, said bearing elements of one of said pairs disposed between said bearing elements of said other pair.

25. The spinning machine as in claim 1, wherein at least one of said longitudinal structural elements comprises a pipe element.

26. An open end spinning machine having a plurality of spinning stations disposed adjacent each other along at least one side of the spinning machine; said spinning machine comprising:

a plurality of longitudinal structural elements running lengthwise along each side of said spinning machine;

a plurality of discrete assemblies for each said spinning station, whereby at least one said assembly comprises a spinning element, at least another said assembly comprises at least part of a drive unit for said spinning element, and at least a third said assembly comprises an opener unit whereby each said assembly of each said spinning station is removably attached to at least two of said longitudinal structural elements; and a limit stop disposed between two said spinning stations, whereby said assembly with the opener unit of at least one of said two spinning stations directly bears against said limit stop, and said assembly with at least part of the drive unit for the spinning element bears against said assembly with the opener unit.

27. An open end spinning machine having a plurality of spinning stations disposed adjacent each other along at least one side of the spinning machine; said spinning machine comprising:

a plurality of longitudinal structural elements running lengthwise along each side of said spinning machine;

a plurality of discrete assemblies for each said spinning station, whereby at least one said assembly comprises a spinning element, at least another said assembly comprises at least part of a drive unit for said spinning element, and at least a third said assembly comprises an opener unit whereby each said assembly of each said spinning station is removably attached to at least two of said longitudinal structural elements; and a limit stop disposed between two said spinning stations, whereby said assembly with at last part of the drive unit for the spinning element of at least one of said two spinning stations directly bears against said limit stop, and said assembly with the opener unit bears against said assembly with at least part of the drive unit for the spinning element.

28. An open end spinning machine having a plurality of spinning stations disposed adjacent each other along at least one side of the spinning machine; said spinning machine comprising:

a plurality of longitudinal structural elements running lengthwise along each side of said spinning machine;

a plurality of discrete assemblies for each said spinning station, whereby at least one said assembly comprises a spinning element, at least another said assembly comprises at least part of a drive unit for said spinning element, and at least a third said assembly comprises an opener unit whereby each said assembly of each said spinning station is removably attached to a common said longitudinal structural element and at least one other said longitudinal structural element, wherein each said assembly is supported on said common said longitudinal structural element by at least one bearing element, said bearing element acting as a limit stop along said common longitudinal structural element for its respective said assembly, each said bearing element of one said assembly directly bearing against another said bearing element of another said assembly.

29. The spinning machine as in claim 28, wherein each said assembly comprises a pair of said bearing elements for being supported on said common longitudinal structural element.

30. The spinning machine as in claim 28, wherein said spinning element assembly comprises a cover supported on said common longitudinal structural element by said bearing element, said bearing element of said assembly with at least part of the drive unit of the spinning element is disposed between and bears against said respective bearing elements of said assembly with the opener unit and said cover.

31. The spinning machine as in claim 30, wherein said cover and said assemblies each comprise a pair of bearing elements, said pairs of bearing elements being identically disposed along said common longitudinal structural element with each said bearing element of said spinning element drive unit assembly disposed between and bearing against one of said cover bearing elements and one of said bearing elements of said opener unit assembly.

32. An open end spinning machine having a plurality of spinning stations disposed adjacent each other along at least one side of the spinning machine; said spinning machine comprising:

a plurality of longitudinal structural elements running lengthwise along each side of said spinning machine;

a plurality of discrete assemblies for each said spinning station, whereby at least one said assembly comprises a spinning element, at least another said assembly comprises at least part of a drive unit for said spinning element, and at least a third said assembly comprises an opener unit whereby each said assembly of each said spinning station is removably attached to at least two of said longitudinal structural elements; and a plurality of transversal bracing members interconnecting said longitudinal structural elements, said bracing members disposed between pairs of said spinning stations so that at least one side of each spinning station is adjacent a said bracing member, said transversal bracing members comprising an intermediate wall and at least one said assembly of each said spinning station on each side of said wall bears directly against said wall.

33. The spinning machine as in claim 32, wherein said bearing elements of said assemblies bearing against each side of said wall bear directly against said wall, said wall acting as a limit stop for said assemblies.

* * * * *